US009868311B2

(12) United States Patent
Dugge et al.

(10) Patent No.: US 9,868,311 B2
(45) Date of Patent: Jan. 16, 2018

(54) IN-LINE CASE PRINTING SYSTEM WITH DYNAMIC SAMPLING FREQUENCY AND METHOD THEREFOR

(71) Applicant: The Procter & Gamble Company, Cincinnati, OH (US)

(72) Inventors: Johann Dugge, Schaerbeek (BE); Geoffrey John Kerr, Geneva (CH)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/714,511

(22) Filed: May 18, 2015

(65) Prior Publication Data

US 2016/0339726 A1 Nov. 24, 2016

(51) Int. Cl.

| | |
|---|---|
| ***B41J 29/393*** | (2006.01) |
| ***B41J 2/165*** | (2006.01) |
| ***B41J 2/21*** | (2006.01) |
| ***B65B 61/26*** | (2006.01) |

(52) U.S. Cl.

CPC ..... *B41J 29/393* (2013.01); *B41J 2/16579* (2013.01); *B41J 2/2142* (2013.01); *B65B 61/26* (2013.01); *B41J 2029/3935* (2013.01)

(58) Field of Classification Search

CPC . B41J 29/393; B41J 2029/3935; B41J 2/2132

USPC ..... 347/14, 19, 101, 104

See application file for complete search history.

(56) References Cited

U.S. PATENT DOCUMENTS

| | | | | |
|---|---|---|---|---|
| 5,162,119 | A * | 11/1992 | Pappas | A21C 9/04 101/106 |
| 5,570,632 | A * | 11/1996 | Cumens | G06K 13/00 101/35 |
| 6,175,700 | B1 | 1/2001 | Miller et al. | |
| 7,413,276 | B2 | 8/2008 | Garcia et al. | |
| 7,543,903 | B2 | 6/2009 | Little | |
| 7,619,771 | B2 | 11/2009 | Jacob et al. | |

(Continued)

FOREIGN PATENT DOCUMENTS

| | | | |
|---|---|---|---|
| JP | 2014188783 | A | 10/2014 |
| WO | WO 2004/007094 | A1 | 1/2004 |
| WO | WO201411435 | A1 | 1/2014 |

OTHER PUBLICATIONS

U.S. Appl. No. 14/685,617, filed Apr. 14, 2015, Miguel Brandt Sanz, et al.

(Continued)

*Primary Examiner* — Sharon A Polk

(74) *Attorney, Agent, or Firm* — Larry L. Huston

(57) ABSTRACT

A dynamic and adaptive control system for printing cases for and individual packages of consumer products. The system prints one or more checkmarks at a predetermined frequency. As the quality parameters of the checkmark[s] drift from the target criteria towards unacceptable range[s] sampling frequency is autonomously increased proportionately. This system enables one to monitor and act upon a greater range of process parameters than conventional systems, as different checkmarks may be printed in limited space therefor on different packages. This arrangement also reduces unacceptable production, by sampling each case/package if necessary, notifying the operator when corrective action is needed.

19 Claims, 3 Drawing Sheets

(56) References Cited

U.S. PATENT DOCUMENTS

| | | | | |
|---|---|---|---|---|
| 7,766,245 | B2 * | 8/2010 | Pinchen | G06K 7/14 235/435 |
| 7,831,863 | B2 | 11/2010 | Kusko et al. | |
| 8,150,106 | B2 | 4/2012 | Wu et al. | |
| 8,452,195 | B2 * | 5/2013 | Rossell | B41J 11/002 347/19 |
| 8,522,515 | B2 * | 9/2013 | Carter | B65D 85/10 53/131.2 |
| 8,355,639 | B2 | 10/2013 | Paul et al. | |
| 2005/0207768 | A1 | 9/2005 | Suzuki | |
| 2006/0011504 | A1 * | 1/2006 | Gosebruch | G06K 17/00 206/459.5 |
| 2008/0021877 | A1 | 1/2008 | Saito et al. | |
| 2008/0079763 | A1 | 4/2008 | Abrott | |
| 2013/0208042 | A1 | 8/2013 | Ueshima | |
| 2014/0210890 | A1 * | 7/2014 | Kinas | B41J 11/42 347/14 |

OTHER PUBLICATIONS

PCT Search Report; PCT/US2016/032623; 13 Pages; dated Sep. 2, 2016.

* cited by examiner

IN-LINE CASE PRINTING SYSTEM WITH DYNAMIC SAMPLING FREQUENCY AND METHOD THEREFOR

FIELD OF THE INVENTION

The present invention relates to a quality control system for printing on cases usable to contain consumer products, and more particularly, to a quality control system which dynamically adjusts print checks during manufacture.

BACKGROUND OF THE INVENTION

Printing of indicia on packaging, particularly corrugated cases and related packaging used for shipping, and increasingly display, of consumer products is well known in the art. But as more packaging becomes 'shelf-ready' and placed directly on a retail shelf, the demand for improved print quality has increased.

Print quality can be adversely affected by variations in line speed, vibration of the line, misalignment of print heads relative to one another, misalignment of print heads relative to the desired position on the case or package, clogging of print nozzles, etc. If the printing is out of specification, the case or package may not be suitable for display. Product may either be scrapped or re-packed, increasing manufacturing cost.

Additionally, a line may be used to print indicia on a short-term basis. For example, promotional packaging may include indicia specific to that promotion. At the same time long term indicia may remain on the same products. For example, trademarks, instructions for use and legally required indicia may be printed on an ongoing basis. But indicia related to, e.g. a holiday promotion or price adjustment may be added on a short term basis. Each of the short term and long term indicia may have separate or dedicated banks of print nozzles.

Various attempts have been made to overcome these problems. For example, diagnostic checkmarks have been printed on cases. But this attempt can be unsightly if the checkmarks are visible to the consumer. And printing a checkmark on each unit can be wasteful if the line is running properly. Even printing at a set, pre-determined frequency is wasteful if the line is running is within acceptable specifications. And a checkmark for long term indicia may be unnecessary if startup problems only occur with short term indicia. Accordingly, a better system is needed.

Related attempts include U.S. Pat. No. 7,413,276, U.S. Pat. No. 7,543,903, U.S. Pat. No. 7,831,863, U.S. Pat. No. 8,150,106, U.S. Pat. No. 8,355,639, US 2008021877, US2005207768, JP 2001239730, JP2006211665, JP2014188783, WO201411435 and commonly assigned U.S. Ser. No. 14/685,617.

SUMMARY OF THE INVENTION

The invention comprises a device for controlling printing of at least one indicium on a case. The device comprises: a printer for applying at least one checkmark to a first plurality of said cases at a predetermined frequency. A different printer, or preferably the same printer also applies at least one indicium to a second plurality of cases. The indicium can comprise artwork and/or convey information. The device has a conveyor for transporting the cases relative to the printer at a predetermined conveyor speed, so the cases may be selectively printed by the printer. The device has an analyzer for determining whether or not the checkmark has acceptable status, borderline status or unacceptable status according to one or more predetermined criteria. A feedback loop increases, decreases or maintains the predetermined frequency of applying the at least one checkmark to the first plurality of cases in response to said status of said one or more predetermined criteria.

More particularly, a the device may use a checkmark printer for applying a plurality of first checkmarks to a first plurality of said packages at a first predetermined frequency and a second plurality of indicia to a second plurality of packages at a second predetermined frequency, where the first plurality of packages and said second plurality of packages are different from the other; and use an indicium printer for applying at least one indicium to each of the packages in both the first plurality and the second plurality. The indicium printer and checkmark printer may be the same printer or comprise two different printers.

In another embodiment, the invention comprises a related method for controlling printing of indicia on packages.

DETAILED DESCRIPTION OF THE INVENTION

Figure 1:
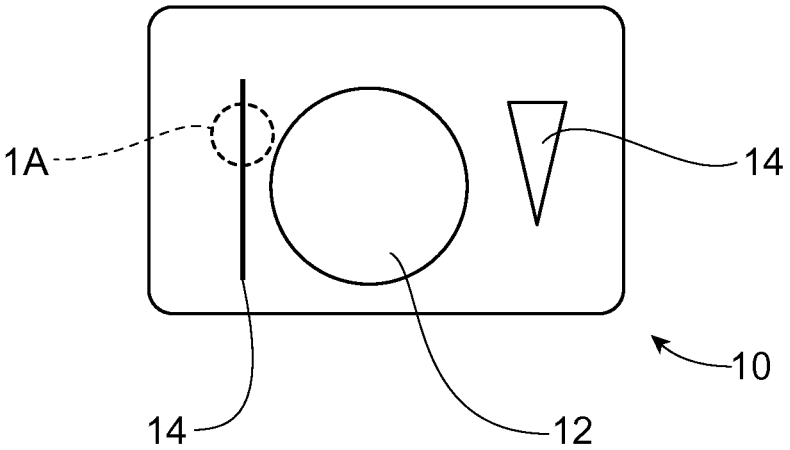
FIG. 1 is a schematic frontal view of a package, having indicia and two checkmarks.

Referring to FIG. 1, a package (10) may be printed according to the present invention with zero, one or more indicia (12). The same package (10) may be printed with zero, one or more checkmarks (14).

Printing of packaging for consumer products may be strictly black and white, or such other color combinations which provide a monochromatic ink color on a packaging substrate. Alternatively, color printing may be utilized, with one or more ink colors be used individually or blended in various proportions to provide a like number of color hues.

Figure 2:
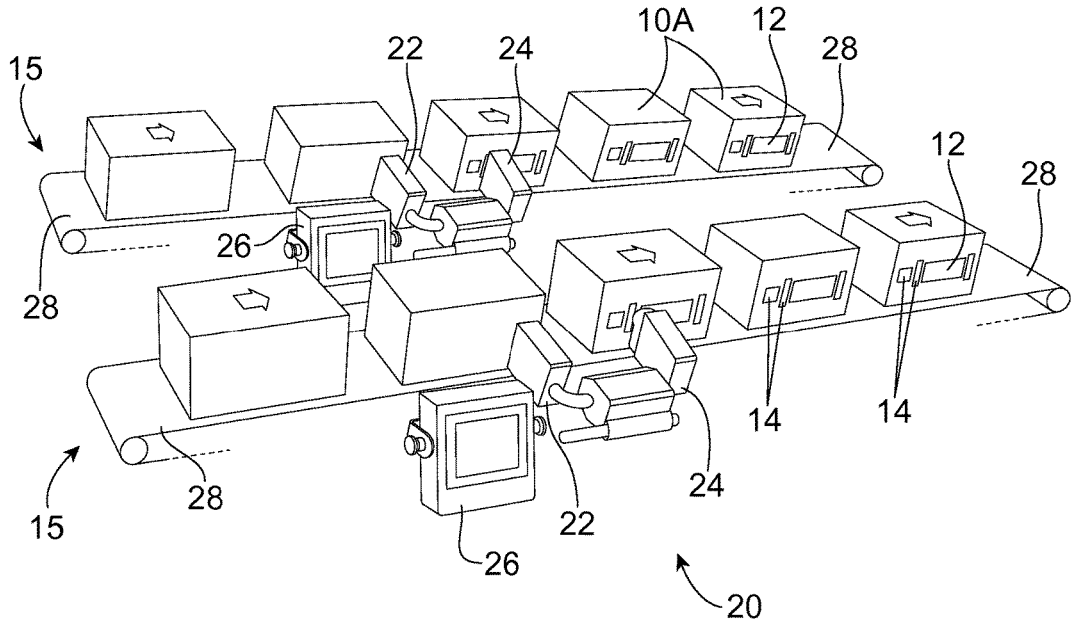
FIG. 2 is a schematic perspective view of an in line case printing system usable with the present invention and having two printing lines.

Referring to FIG. 2, an in line case (10A) printing system according to the present invention may have a single printing line (15) or a plurality of printing lines (15). Each printing line (15) may comprise a device (20) having one or more printers (22), analyzers (24) and/or controllers (26). The controllers (26) provide the human machine interface where information regarding the checkmark (14) may be transmitted from an analyzer (24) to one or more respective controllers (26). The information may include magnified images of the checkmarks (14), go/no go lights, data tables/graphs, etc. This information may alert an operator to the need for imminent or impending corrective action.

If color printing is selected, a common four head printer (22) may have four colors, such as, black, cyan, magenta and yellow. Together these colors can be blended to provide a broad spectrum of colors. The colors can be adjusted to compensate for differences in the substrate, such as a darker colored corrugated or lighter colored kraft board.

A suitable printer (22) for black and white, or other monochromatic printing is a Markem 5400 available from Markem-Imaje Company of Keene, N.H. A suitable printer (22) for color printing, particularly four color, printing is a Limitag V5 LCMYK, available from V. L. Limitronic, S. L. Company of Castellon, Spain. A color printer (22) may have one nozzle or plural nozzles designated for each color. The printer (22) may have one or more banks of ink nozzle[s] and be suitable to print an image up to 70 mm in vertical dimension. It is understood that images with greater dimensions may be printed using plural nozzles to concatenate adjacent portions of the image.

A checkmark printer (22) may print checkmarks (14), usable for diagnostic purposes, as described herein. An indicia printer (22) may also be used to print indicia (12). The indicia (12) may be aesthetically pleasing, comprising artwork and/or provide information. Information may relate to contents, instructions for use, a bar code, QR code, trademarks, etc. The indicia (12) may be the same for each case (10A), may be different or may be omitted as desired for certain cases (10A). The same printer (22) or different printers (22) may be used for printing the diagnostic checkmarks (14) and for printing the other indicia (12). As used herein the checkmark printer (22) and the indicia printer (22) can be a single common printer (22) or comprise a plurality of printers (22).

The printing may occur on packaging, such as a case (10A), as is used to contain plural packages (10) of consumer products, trays or banding, used to bundle plural consumer products, individual packages (10) of consumer products and other packaging therefor. One of skill will understand these terms may be used interchangeably and include each of the foregoing without departure from the claimed invention.

The device (20) has a conveyor for moving the printer[s] (22) and cases (10A) relative to one another. One common conveyor is a powered, moving continuous belt. Cases (10A) are placed on the belt while stationary or preferably in motion, then transported to and past the printer[s] (22). After the indicium[a] (12) and/or checkmark[s] (14) is/are printed on the desired cases (10A) and checked with a machine vision system or other analyzer (24) or, as described below, the cases (10A) may be removed from the conveyor.

The analyzer (24) may be disposed immediately after the printer (22), to minimize time necessary to correct drift in monitored parameters. Alternatively or additionally, the analyzer (24) may be disposed at the end of the conveyor or manufacturing line (15), to ensure detection of parameter drift caused by all factors throughout the line (15).

The conveyor may transport the cases (10A) at a predetermined speed. As print quality is judged to be of acceptable status, a feedback loop may increase the transport speed of the conveyor. As print quality is judged to be of borderline or unacceptable status, a feedback loop may decrease the transport speed of the conveyor and/or may stabilize transport speed to reduce speed fluctuations. Or the feedback loop may maintain current conveyor line (15) speed.

Alternatively or additionally, the device (20) may automatically adjust printhead/nozzle position in response to a status signal that image position of the indium is off-position. Printhead position may be adjusted using an ILE2K motor from Schneider Electric of Rueil-Malmaison. Or printhead position adjustment may be accomplished as part of the normal operation and functioning of the printer (22). Additionally or alternatively, the printer (22) may be re-phased.

Alternatively or additionally, the device (20) may be used to reject cases (10A) judged to be of unacceptable image quality. A rejected case (10A) may be diverted from the conveyor, using a reject gate as is well known in the art.

Figure 3:
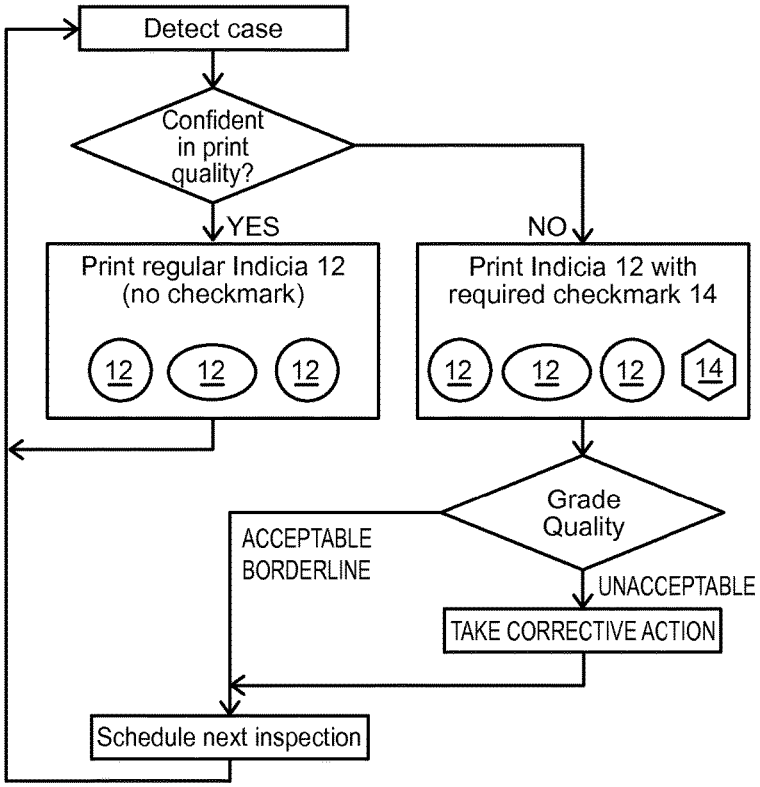
FIG. 3 is a flow chart of an algorithm for the overall process of the present invention.

Referring to FIG. 3, diagnostic checkmarks (14) may be printed to detect specific quality issues and simplify automatic inspection, in lieu of a system that relies upon human vision and perception to grade quality. But the checkmarks (14) may be unsightly and may be intended to not be seen by the consumer. Accordingly, and optionally, the checkmarks (14) may be embedded in the artwork and be less noticeable to the consumer. And/or the checkmarks (14) may be printed on flaps which are later folded, concealing the checkmarks (14).

Figure 1A:
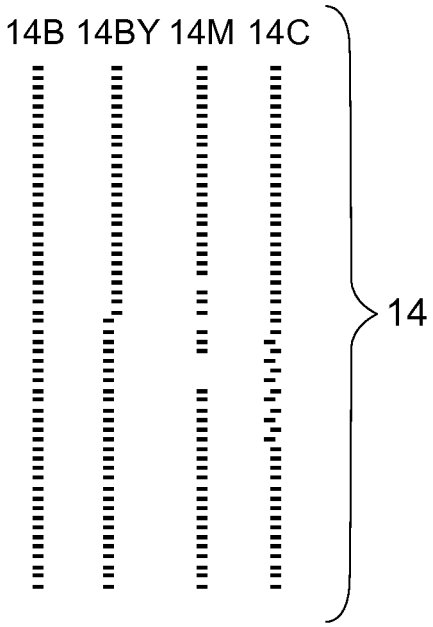
FIG. 1A is an enlarged schematic view of a checkmark shown in FIG. 1.

Referring to FIG. 1A, a checkmark (14) may comprise broken lines, printing four colors. One of the lines (14B) may be black and show, for example, acceptable print quality. One of the lines (14BY) may have a black portion at the top, aligned to the right and a yellow portion at the bottom, aligned to the left and show, for example, print mis-aligned between these two colors. One of the lines (14M) may be magenta and show, for example, skipped print, possibly indicating clogged nozzles. One of the lines (14C) may be cyan and show, for example, uneven print width, possibly due to deviated ink drop placement. The checkmarks (14) may be printed on the same face of the case (10A) or upon any desired number of faces thereof. Preferably, a single-line checkmark (14) is not visually noticeable to the consumer.

Figure 4:
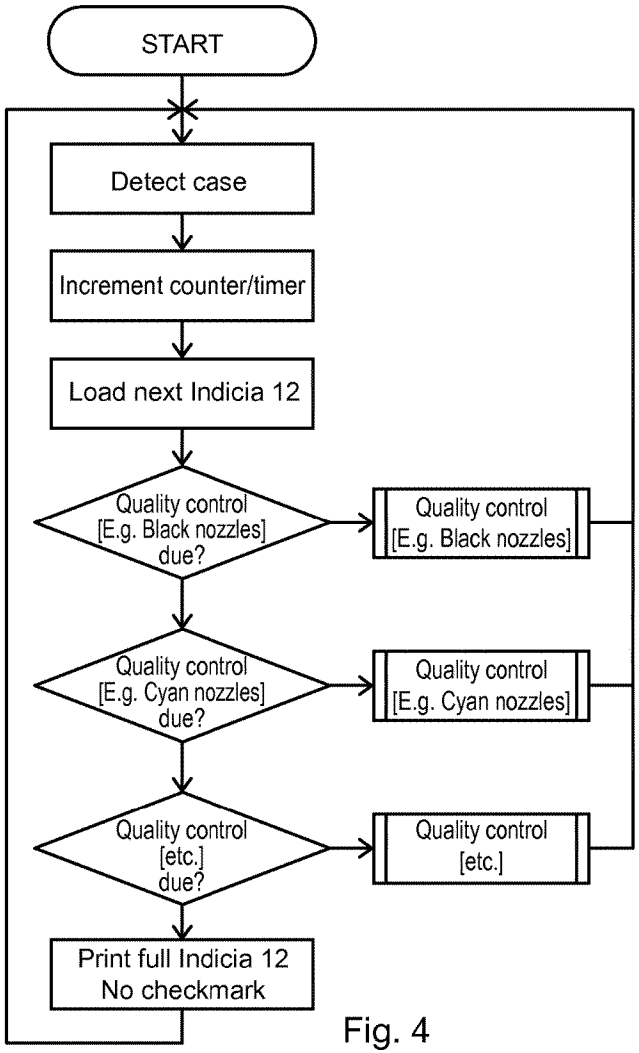
FIG. 4 is a flow chart of an algorithm for a multivariable process of the present invention.

Referring to FIG. 4, a variety of checkmarks (14) may be used for different diagnostic purposes. For example according to one algorithm, each color and, even each individual nozzle of a color, may have a checkmark (14) to determine whether or not a nozzle is plugged or not allowing sufficient ink flow. The same or different checkmark[s] (14) may be used to determine if that particular nozzle has applied ink to the right position on the artwork. The same or different checkmark[s] (14) may be used to determine if that particular nozzle has printed in the right position relative to other nozzle[s]. The same or different checkmark[s] (14) may be used to determine if the indicia (12) forming the artwork is complete or if a skipped print has occurred. Thus, checkmarks (14) may particularly include one or more registration marks, usable, for example, to determine whether or not all printer (22) nozzles are properly spaced relative to one another, are properly spaced in absolute position on the package (10), if there are deviant ink drops on the wrong position, etc. Other checkmarks (14) could include color patches to check color accuracy. Any of the aforementioned checkmark[s] (14) may be printed in any combination[s] with other checkmark[s] (14).

For example, package (10) 1 may have a single checkmark (14) or plural checkmarks (14). Package (10) 1+X may have any of the forgoing checkmark[s] (14) alone or in combination with the same and/or other checkmarks (14). X is an integer number of subsequent packages (10), as counted in units or otherwise.

Each checkmark (14) may have a specific quality range for that diagnostic criterion[a]. If the checkmark (14) is determined to meet and be within the quality range, no additional action is necessary. Sampling via more checkmark[s] (14) may continue at the predetermined frequency or reduced frequency if the diagnostic criterion has acceptable status.

But if the checkmark (14) is determined to be outside the acceptable quality range, corrective action may be taken. For example, maintenance may be performed to adjust nozzle position[s], clean a clogged nozzle[s], adjust timing of ink delivery[ies], replenish ink supply[ies], etc.

Figure 5:
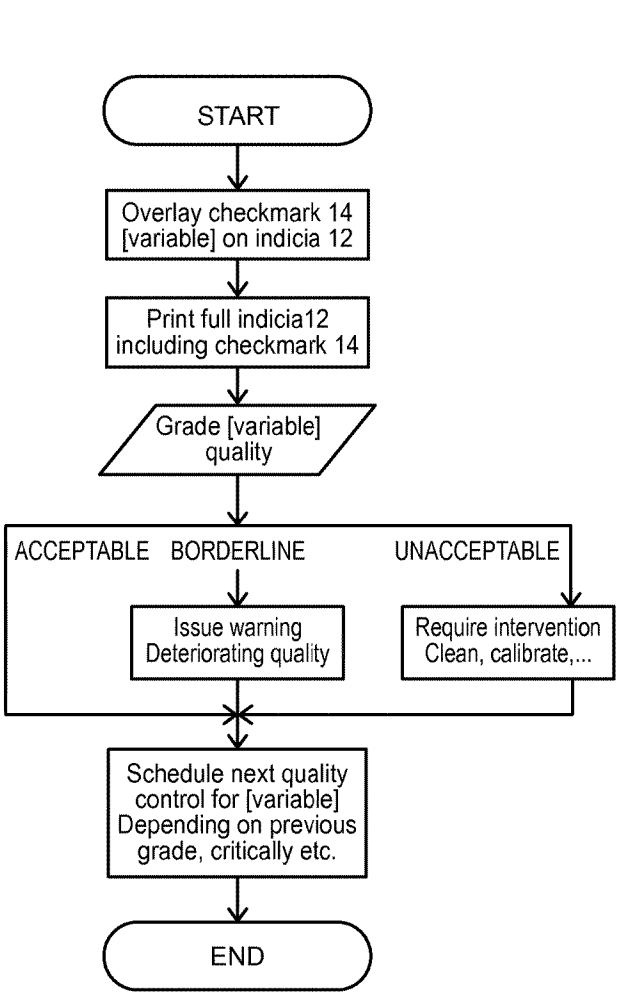
FIG. 5 is a flow chart of an algorithm for the inspection portion of the process of the present invention.

Referring to FIG. 5, the checkmark[s] (14) may not immediately go from acceptable quality/status, within the desired range to unacceptable quality/status outside the desired range. Often the checkmark[s] (14) will drift from the respective target range into a respective borderline range/status. Quality in the borderline range may be acceptable for shipment and continued production, but can serve as a warning to the operator that corrective action will soon be needed. During this time production may continue, but extra monitoring is warranted to minimize, and preferably prevent unacceptable production from occurring. One of skill will recognize that a checkmark (14) may simply be graded, for trends or to further resolve issues within acceptable, borderline or unacceptable status.

Accordingly and under one suitable algorithm, when a checkmark (14) shows borderline performance/status of the respective criterion[a], increased sampling frequency may occur. Instead of sampling every nth package (10), sampling may occur at S1*n packages (10) where n is the original sampling frequency and S1 is a sampling coefficient greater than 0 and less than 1. S1 can be from 0.001 to 0.9; from 0.01 to 0.75, from 0.1 to 0.5 or any range or value therebetween.

If the borderline performance continues to drift towards the unacceptable, sampling frequency may again be stepwise increased. Sampling may occur at S2*n packages (10) where n is the original sampling frequency and S2 is a sampling coefficient between 0 and S1. This process may be repeated for sampling frequencies of S3*n, S4*n, etc. as needed, until, if desired, each individual package (10) is sampled. Of course, the sampling algorithm may be stationery, based upon the original sampling frequency of every nth package (10). Or the sampling algorithm may be dynamic, where the revised sampling frequency becomes the new n package (10) count.

Alternatively, if the borderline performance drifts back towards the target or is brought within specifications by acting upon the device (20) process parameters, stepwise decreased sampling may occur, until the original sampling frequency occurs again. Of course, if the borderline performance re-drifts in either direction, sampling frequency may be adjusted accordingly. Of course larger drifts in performance may result in proportionately larger stepwise increases or decreases in sampling frequency than smaller drifts in performance.

Sampling frequency may be determined by an algorithm as determined by and stored in an Insight 7200C camera available from Cognex of Natick, Mass., USA. Particularly, each checkmark (14) may be analyzed for its specific diagnostic criterion[a]. The checkmark (14) may be analyzed with an analyzer (24) which is part of the Cognex Insight 7200C camera. The checkmark (14) may include machine readable code, such as Data Matrix ECC200 symbology, the Postnet numerical encoding technique, Codabar, Code 128, Code 39, Code-93, EAN-13, EAN 8, Industrial 2 of 5, Interleaved 2 of 5, ISBN-13, ITF-14, LOGMARS, MSI Plessey, Planet, UCC/EAN-128, UPC-A, UPC-E, UPSC Stack Label, UPSC Tray Label, USS-93, etc. The machine readable code may be used to synchronize checkmark printing and analysis.

In operation, the vision system may receive a signal from an external sensor, an internal timer, an external trigger, or combination thereof to take a photograph of the checkmark (14) as it passes in front of the camera. The camera then takes a photograph of the checkmark (14) according to a time delay based upon conveying speed. An image processor in the analyzer (24) determines which particular checkmark [s] (14) to analyze. The printer (22) can communicate to an analyzer (24) in, or in communication with, the camera to indicate which checkmark (14) had been printed. Or an internal memory of the image processor may designate which checkmark (14) had been printed and indicate the same.

The checkmark (14) may be located, and preferably isolated, in the indicium (12) to account for small variability in triggering, etc. For example the image processor may search for the location of features, e.g. the shape of a certain color of the checkmark (14). The checkmark (14) is then analysed for the associated criteria[ion] e.g. whether or not the vertical line[s] show any gaps that may indicate clogged nozzles, or even whether or not the line is straight. The processor then schedules the next check.

If no checkmark (14) is printed the sensor may still be used to verify that a print has occurred at all. Such verification can be achieved by determining whether or not the substrate has undergone a change in color.

The checkmark (14) may be determined to meet or fail one or more of its criteria[ion] according to Table 1 below.

TABLE 1

| Package No. | Meets Target Quality Range | Borderline Target Quality Range | Outside of Target Quality Range |
|---|---|---|---|
| 1 | Continue sampling frequency<br>Optionally increase line speed | Increase/decrease sampling frequency | Take corrective action |
| 2 | Continue sampling frequency<br>Optionally increase line speed | Increase/decrease sampling frequency | Take corrective action |
| . . . X | Continue sampling frequency<br>Optionally increase line speed | Increase/decrease sampling frequency | Take corrective action |

One of skill will recognize that sampling frequency may be based upon time instead of or in addition to individual package (10) count. The system may sample every Y seconds at the outset. As the system continues production, sampling frequency may increase to every S1*Y seconds, where S1 is a sampling coefficient less than 1. If borderline quality issues are detected, sampling frequency may increase, as set forth above. This process may be repeated, and sampling frequency increased, until, if desired, every package (10) is sampled.

If the quality is determined to meet the target quality range, after a period of time, sampling frequency may increase to S2*Y where Y is the original sampling frequency [based upon time] and S2 is a sampling coefficient between 0 and S1.

For example, Y may be set at 100, to designate 1% of all packages (10), or every one-hundredth package (10), is sampled. If the sampling frequency warrants, the algorithm may set S1 equal to 0.5. Then $S1 \times Y = 0.5 \times 100 = 50$, or every $50^{th}$ package (10) is sampled. If the criteria in the target quality range should become less favorable, S2 may be introduced as 0.25. Then $S2 \times Y = 0.25 \times 100 = 25$, or every $25^{th}$ package (10) is sampled. This process may be repeated for S3 less than S2, S4 less than S3 and . . . SN less than SN−1 according to a predetermined algorithm.

Again, this process may be repeated and frequency increased until, if desired, each package (10) is sampled. An upper limit may be set for Y, to ensure a minimum sampling frequency occurs.

Thus, one or more checkmarks (14) are only printed when needed (i.e. after a certain number of prints or time has elapsed) to verify current process. One of skill will recognize that any particular checkmark (14) may be printed independent of or in concert with any other checkmark (14). For example, if skipped print of one or more cyan nozzle[s] is detected, but still within the borderline range for clogging of that respective nozzle, increased sampling frequency may occur for other nozzles having maintenance/replacement during the same time period or may occur for all nozzles.

In a non-limiting example, a particular printer (22) may have a bank of 1, 128, 256 or 512 nozzles of each color. Each color typically has the same number of respective nozzles, although one color may have more less nozzles as desired. If, for example, a checkmark (14) shows one or more cyan nozzles are plugged, more cyan checkmarks (14) may be printed. For example, a first cyan checkmark (14) may check every n nozzles (such as 1, 6, 11, 16, 21 . . . ), a second cyan checkmark (14) may check every n+1 nozzles (such as 2, 7, 12, 17, 22 . . . ), a third cyan checkmark (14) may check every n+2 nozzles (such as 3, 8, 13, 18, 23 . . . ), etc. The first, second third . . . checkmarks (14) may be sampled at the desired individual frequencies according to meeting the target quality ranges. This process may be repeated for each color and/or bank of nozzles.

Alternatively, for example, if a black nozzle is determined to be out of position, increased sampling frequency of only that nozzle may occur, as desired. Thus, depending on the measured results of any prior diagnostic, the system may autonomously and dynamically schedule the next quality diagnostic test and/or sampling frequency.

Additionally, the device of the present invention may provide for manual intervention. If the operator suspects that a quality defect may be occurring or even incipient, the operator may cause a checkmark (14) to be printed and subsequently analyzed. In real time the operator may be alerted to, for example, the need to adjust print head position.

A feedback loop may be disposed between the analyzer (24) and the printer (22) which provides the checkmark (14). The feedback loop may increase or decrease print frequency of the checkmark (14) according to a predetermined algorithm. The algorithm may increase frequency according to one or more criteria analyzed by the analyzer (24). The algorithm may also be used to determine what corrective action, if any, is called for, and the magnitude of the correction.

The number of criteria approaching, or outside, desired limits may influence sampling, e.g. checkmark (14), frequency. As more criteria approach the borderline or unacceptable limits, sampling frequency may increase. It is not necessary that all criteria be sampled at the same frequency. If some criteria remain with acceptable specifications, and other criteria[ion] drift towards or to borderline or unacceptable, only the latter criteria[ion] may be subject to increased sampling. Or increased sampling of additional related criteria or even all criteria may occur. Again the sampling frequency may be determined and controlled by the feedback loop. Likewise, the magnitude of the drift of one or more criteria may influence subsequent sampling frequency. As a particular criterion moves further towards or into the borderline or unacceptable range, increased sampling of only that criterion may occur. Or increased sampling of additional related criteria or even all criteria may occur. Again the sampling frequency may be determined and controlled by the feedback loop.

The present invention provides the benefit of reducing the printing of checkmarks (14) by not every case (10A) having a checkmark (14) printed on it to prevent unacceptable quality and rejects from occurring. Printing of checkmarks (14) need occur only as required by process stability and operational status and may be autonomously and dynamically adjusted in response to changes in the system or operating conditions. Further, with the dynamic system of the present invention, not all checkmarks (14) have to be printed at the same time, reducing the area required for checkmarks (14) in a single indicium (12). This automated/adaptive change in sampling frequency prophetically reduces production costs, compared to basing sampling frequency on human intervention.

Space to print checkmarks (14), particularly registration marks is often limited, particularly for smaller packages (10). Advantageously, this system enables one to monitor and act upon a greater range of process parameters than occurs within conventional systems, as different checkmarks (14) may be printed in limited space therefor, on different packages (10).

In another embodiment the invention may comprise an algorithm for controlling printing of at least one indicium (12) on a case (10). The algorithm cooperates with a device (20) having a printer (22) for applying at least one checkmark (14) to a first plurality of said cases (10) at a predetermined frequency, a same or different printer (22) for applying at least one indicium (12) to a second plurality of cases (10), a conveyor (28) for transporting these cases (10) relative to the printer (22) at a predetermined speed, so that the cases (10) may be selectively printed. The device (20) controlled by the algorithm also has an analyzer (24) for determining whether or not the checkmark (14) has acceptable status, borderline status or unacceptable status according to one or more predetermined criteria.

The algorithm receives the status and uses a feedback loop for increasing, decreasing or maintaining the predetermined frequency of applying at least one checkmark (14) to the first plurality of cases (10) in response to the status of said one or more predetermined criteria. More particularly, the algorithm may use a feedback loop between the analyzer (24) and checkmark printer (22) for increasing, decreasing or maintaining a predetermined frequency of applying the first checkmark (14) and another predetermined frequency of applying the second checkmark (14) to the first plurality of cases (10) and second plurality of cases (10), respectively, in response to the statuses of one or more predetermined criteria.

One of skill will recognize this device (20) may be used with other types of indicia (12), not involving printing. For example, the system may be used with laser ablation, laser scoring, and laser coloring of coatings sensitive to the actinic light of the laser. Such systems are available from Datalase of Cheshire, U.K. This device (20) may also be used with the application of sticker systems.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for controlling printing of at least one checkmark on a case, said device comprising:

a printer for applying at least one checkmark to a first plurality of said cases at a predetermined frequency;

an analyzer for determining whether or not a first plurality of checkmarks printed on a case in a first plurality of cases has acceptable status, borderline status or unacceptable status according to one or more predetermined criteria;

a feedback loop for increasing, decreasing or maintaining said predetermined frequency of applying said at least one checkmark to said first plurality of cases in response to said status of said one or more predetermined criteria, wherein said device prints and analyzes every nth case according to a predetermined algorithm and increases the frequency of printing and analyzing said cases in response to said status of said predetermined criteria.

2. A device according to claim 1 wherein said at least one checkmark comprises plural criteria, said plural criteria being measurable on said cases having said checkmark applied thereto for status determination by said analyzer.

3. A device according to claim 1 wherein said checkmark includes machine readable code.

4. A device for controlling printing of at least one checkmark on a case, said device comprising:

a printer for applying at least one checkmark to a first plurality of said cases at a predetermined frequency;

an analyzer for determining whether or not a first plurality of checkmarks printed on a case in a first plurality of cases has acceptable status, borderline status or unacceptable status according to one or more predetermined criteria;

a feedback loop for increasing, decreasing or maintaining said predetermined frequency of applying said at least one checkmark to said first plurality of cases in response to said status of said one or more predetermined criteria, wherein said device prints and analyzes every nth case according to a predetermined algorithm and increases said conveyor speed in response to said status of said predetermined criteria.

5. A device according to claim 4 which prints a plurality of mutually different checkmarks, and prints only a single one of said plurality of checkmarks on a single case.

6. A device according to claim 4 wherein said analyzer determines the status of criteria selected from the group consisting of at least print registration, nozzle plugging, nozzle position and combinations thereof.

7. A device for controlling printing of at least one checkmark on a case, said device comprising:

a printer for applying at least one checkmark to a first plurality of said cases at a predetermined frequency;

an analyzer for determining whether or not a first plurality of checkmarks printed on a case in a first plurality of cases has acceptable status, borderline status or unacceptable status according to one or more predetermined criteria;

a feedback loop for increasing, decreasing or maintaining said predetermined frequency of applying said at least one checkmark to said first plurality of cases in response to said status of said one or more predetermined criteria, wherein said device prints a first checkmark on every nth package and a second checkmark on every S1*nth package where S1 is a sampling coefficient between 0 and 1.

8. A device according to claim 7 which does not print said first checkmark and said second checkmark on the same case.

9. A device according to claim 7 which prints said first checkmark and said second checkmark on the same case.

10. A device for controlling printing of indicia on packages, said device comprising:

a checkmark printer for applying a plurality of first checkmarks to a first plurality of said packages at a first predetermined frequency and a second plurality of indicia to a second plurality of packages at a second predetermined frequency, said first plurality of packages and said second plurality of packages being different from the other;

an indicium printer for applying at least one indicium to each of said packages of said first plurality and said second plurality, a conveyor for transporting said packages relative to said printer at a predetermined conveyor speed, whereby said packages may be selectively printed thereon with said indicium and said checkmarks;

an analyzer for determining whether or not at least some of said checkmarks has acceptable status, borderline status or unacceptable status according to one or more predetermined criteria;

a feedback loop between said analyzer and said checkmark printer for increasing, decreasing or maintaining said predetermined frequency of applying said first checkmark and said predetermined frequency of apply said second checkmark to said first plurality of packages and said second plurality of packages, respectively, in response to said statuses of said one or more predetermined criterion.

11. A device according to claim 10 wherein said first plurality of said packages and said second plurality of packages are mutually exclusive.

12. A device according to claim 10 wherein said first plurality of said packages and said second plurality of packages overlap.

13. A device according to claim 10 wherein said first plurality of said packages is greater than said second plurality of packages.

14. A method for controlling printing of indicia on packages, said method comprising the steps of:

applying a plurality of first printed checkmarks to a first plurality of said packages at a first predetermined frequency;

applying a second plurality of printed indicia to a second plurality of packages at a second predetermined frequency, said first plurality of packages and said second plurality of packages being different from the other;

transporting said packages relative to an analyzer at a predetermined speed;

selectively analyzing at least some of said packages to determine whether or not a respective checkmark thereon has acceptable status, borderline status or unacceptable status according to one or more predetermined criteria;

increasing, decreasing or maintaining said predetermined frequency of applying said at least one first checkmark and said second checkmark to said first plurality of packages and said second plurality of packages, respectively, in response to said status of said one or more predetermined criteria, and/or increasing, decreasing or maintaining said predetermined speed of transporting said packages, in response to said status of said one or more predetermined criteria.

15. A method according to claim 14 further comprising the step of rejecting a package which has an indicium having unacceptable status according to a said predetermined criterion.

16. A method according to claim 14 comprising the step of printing a first checkmark at a first checkmark frequency and printing a second checkmark at mutually different a second checkmark frequency.

17. A method according to claim 16 comprising the step of increasing said first frequency and decreasing said second frequency during a predetermined period of time.

18. A method according to claim 14 wherein at least one said criterion relates to a position of said indicia on said package.

19. A method according to claim 18 comprising the step of printing color checkmarks.

* * * * *